United States Patent [19]

Ochoa et al.

[11] Patent Number: 4,463,934

[45] Date of Patent: Aug. 7, 1984

[54] SAFETY BARRIERS FOR HIGHWAYS AND THE LIKE

[76] Inventors: Pedro S. Ochoa; Pedro S. Cortes, both of Av. M. Gutierrez Zamora No. 88, Mexico 20, D.F., Mexico

[21] Appl. No.: 402,614

[22] Filed: Jul. 28, 1982

Related U.S. Application Data

[63] Continuation-in-part of Ser. No. 149,674, May 14, 1980, abandoned.

[51] Int. Cl.[3] ..... A01K 3/00

[52] U.S. Cl. ..... 256/13.1; 404/6; 256/1

[58] Field of Search ..... 404/6, 7; 256/13.1, 256/1

[56] References Cited

U.S. PATENT DOCUMENTS

| | | | |
|---|---|---|---|
| 739,854 | 9/1903 | Gest | 404/7 X |
| 2,994,255 | 8/1961 | Trief et al. | 404/7 |
| 3,232,187 | 2/1966 | Brigham | 404/7 |
| 3,448,963 | 6/1969 | Gravisse | 256/13.1 |
| 3,807,699 | 4/1974 | France | 256/13.1 |
| 4,074,479 | 2/1978 | Krupka | 404/7 X |

FOREIGN PATENT DOCUMENTS

| | | | |
|---|---|---|---|
| 252983 | 3/1967 | Austria | 404/7 |
| 2141582 | 2/1973 | Fed. Rep. of Germany | 404/7 |
| 2337498 | 2/1975 | Fed. Rep. of Germany | 404/6 |
| 1384518 | 11/1964 | France | 404/7 |
| 2384896 | 10/1978 | France | 404/7 |
| 1090925 | 11/1967 | United Kingdom | 404/7 |

*Primary Examiner*—Andrew V. Kundrat
*Attorney, Agent, or Firm*—William H. Maxwell

[57] ABSTRACT

A highway safety barrier constructed of concrete modules and installed continuously along the margin of a roadway and having a barrier wall of restricted height and a stepped shoulder comprised of offset inclined planes, to steer the angular approaching wheel of a vehicle back toward the traffic lane with a damping action, diminishing the possibility of overturning of the vehicle, increasing the possibility of regaining control of the vehicle, and reducing the possibility of overturning the safety barrier modules.

15 Claims, 5 Drawing Figures

SAFETY BARRIERS FOR HIGHWAYS AND THE LIKE

This application is a continuation-in-part of application Ser. No. 149,674 filed May 14, 1980, and now abandoned.

BACKGROUND

This invention relates to safety barriers for roadways, of which many variations have been proposed and some of which are in use. Thus, the prior art varies from spaced posts of wood, metal and cement, longitudinal members thereof, continuous concrete walls of minimized curb height to more than vehicle height, and metal fences etc., all of which have for their primary function the prevention of vehicles leaving the roadway. There are different modes of operation attributed to such barriers, those which partially or completely collapse upon vehicle impact, and those which remain intact and in place as is the case with the present invention. Also, there are barriers which capture the vehicle wheels so that the vehicle is guided straight ahead, and those which return the vehicle to the roadway, it being a general object of this invention to provide a wheel straightening effect, to prevent or reduce impact forces, and to provide a restriction that prevents or reduces violent rebound of the vehicle onto the roadway.

The height of vehicle safety barriers is a serious problem, in that severe body damage can be caused thereby. That is, the side of a vehicle coming into forceful contact with a barrier wall can virtually destroy the side of said vehicle. On the contrary, it is an object of this invention to prevent or reduce vehicle body damage, by restricting the height of the barrier wall without losing its effectiveness. In practice, a full depth of the tire cross section is engageable with the barrier wall, while the vehicle body parts and namely the front bumper normally clear said barrier wall.

The wheel diameter and chassis height of passenger vehicles vary to some degree, the wheel axis normally being ten to twelve inches above the pavement, and the underside front bumper level normally being twelve to fifteen inches above the pavement. It is an object of this invention to confine barrier wall engagement with the tire as much as practically possible, by restricting the barrier wall height to about twelve inches or to approximately the radius of the vehicle wheel or tire, and so that the front bumper tends to clear the barrier wall under adverse circumstances. This clearance of the front bumper, or that portion of the vehicle chassis, is increased as next described.

The safety barrier of the present invention is of the type which includes an inclined shoulder plane rising to the barrier wall, in which case the body of a vehicle approaching at high velocity will depress, dependent upon softness of its suspension, relative to said shoulder plane, thereby causing the body and/or front bumper to strike the barrier wall. However, it is an object of this invention to preclude or reduce this tendency by providing offset shoulder planes and one of which elevates the oncoming vehicle wheel relative to the other plane from which the barrier wall projects. Overturning or displacement of wall barriers has been a problem, and all of which is solved herein by the extensive shoulder plane or planes completely underlying the active portions of the angularly turned vehicle wheel, and by the comparatively low lying and unobtrusive barrier wall.

It is to be understood that the functions are dynamic and occur only when the vehicle encounters this safety barrier at substantial velocity. This does not however preclude effective low velocity encounters.

Return under control to the roadway; of a vehicle that is temporarily or partially out of control is to be desired. There are safety barriers proposed for this specific purpose, but with no restriction to or damping of the rebound effect. That is, the prior art is devoid of steering correction combined with rebound damping, it being an object of this invention to provide steering correction combined with rebound damping, whereby the course of the vehicle is corrected and so that it returns to the roadway with reduced violence.

The travel angle of vehicle approach to safety barriers of the type under consideration can vary, for example up to 25° with respect to the longitudinal disposition of the barrier wall, any angle in excess of 25° being considered to be more or less beyond that which can be expected and beyond control. However, most angular approaches which are of concern occur within the range of 12° to 15°, and accordingly the safety barrier as it is herein disclosed is designed to the severe angle of 25°, more than adequate to accept the 12° to 15° approach. As will be described, this approach angle is significant, as the rebound barrier is positioned to effectively engage the returning wheel, whereby the return of the vehicle to the roadway is restricted by a damper function.

SUMMARY OF THE INVENTION

The improvement in our traffic safety barrier is its specific configuration which clearly and efficiently lends itself to directing the movement of a vehicle away from the barrier, reduces the chance of the vehicle from overturning, and results in little or no damage either to the barrier or to the vehicle. These objectives are attained by a special cross sectional configuration which includes a shoulder comprised of a first inclined surface plane over which the front wheel of the vehicle will initially ride thereby tending to steer the wheel and the vehicle away from the barrier, and a second inclined surface plane offset down from or recessed below the first surface plane over and/or into which the vehicle wheel moves before engaging the barrier wall. The barrier wall is a raised concaved extension of the second mentioned inclined surface plane and which blends into a convex abuttment portion adapted to engage the side wall of the front wheel tire, thereby creating a further braking and steering action, and from which the vehicle will rebound dependent upon the force of impact. When the force of impact with the barrier wall is slight, the vehicle will tend to slow down and track within the second inclined surface plane that is recessed, whereby steering control is regained and the vehicle can be brought to a stop or returned to the roadway. When the force of impact is great, the vehicle will tend to slow down and rebound across the second inclined surface plane and toward the roadway, in which case a step in the shoulder is encountered by the vehicle wheel to have a retarding action that damps the rebound movement of the vehicle and tends to steer the front wheel ahead. When the velocity of the vehicle is so great that inertia causes the front vehicle wheel to pass over and without touching the second inclined recessed surface plane, said front wheel remains clear of the surface and free to be turned and steered ahead through engagement with the barrier wall. In each of the foregoing impact conditions there is a slowing action, there is a straightening of steering so that control of the vehicle can be regained by the driver, and any rebound is either prevented or damped. In practice, this safety barrier is made in modular sections adapted to be laid and/or set in continuous block formation along the margins of highways and the like.

The foregoing and various other objects and features of this invention will be apparent and fully understood from the following detailed description of the typical preferred form and application thereof, throughout which description reference is made to the accompanying drawings.

Figure 3:
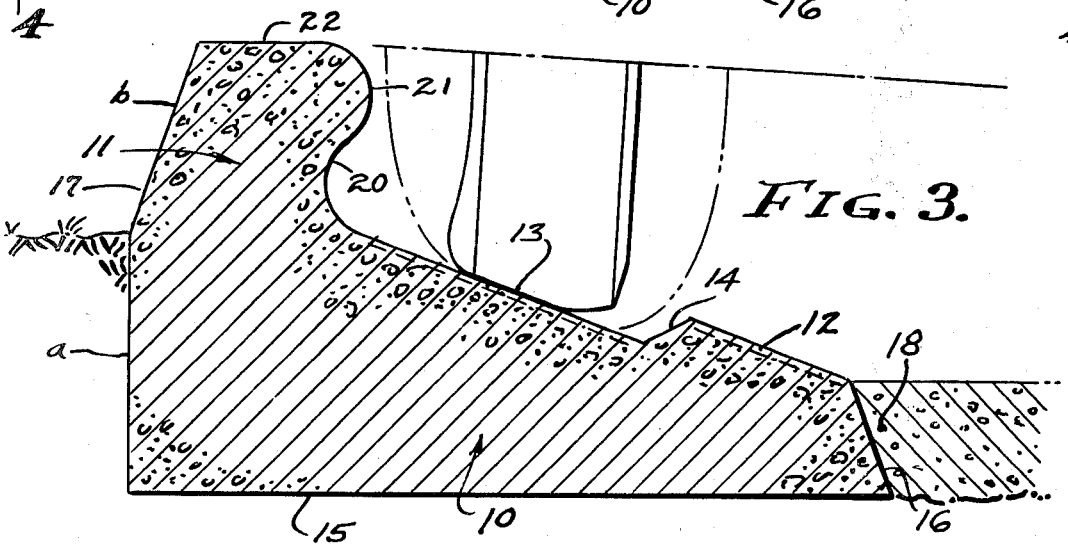
FIG. 3 is a sectional view taken as indicated by line 3—3 on FIG. 1, showing tire engagement with straight alignment in full lines and the tire turned at 25° in phantom lines (to illustrate clearance).
Figure 5:
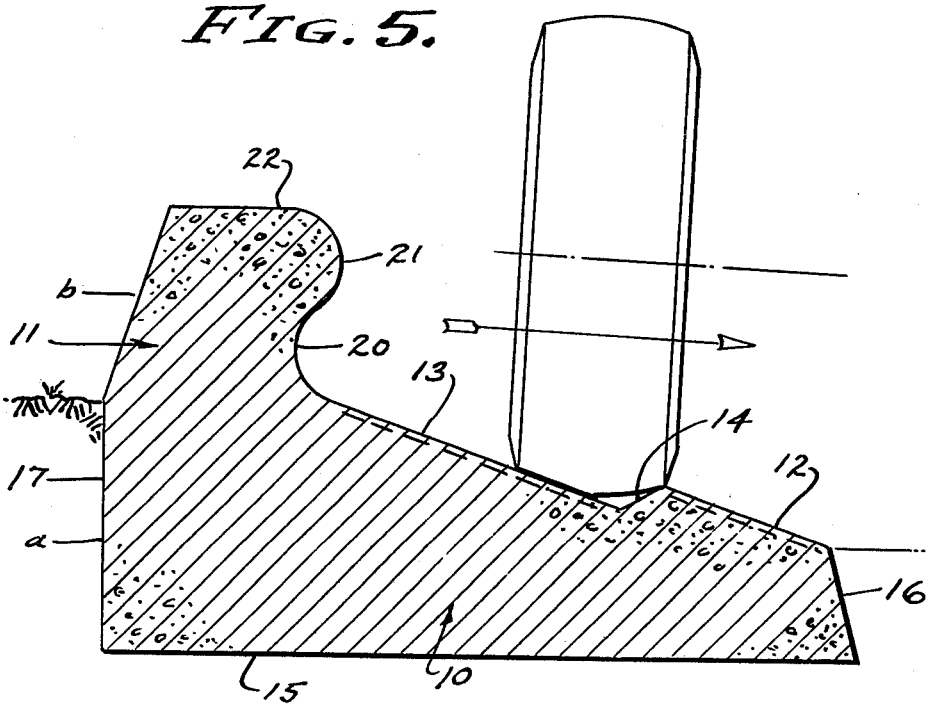

And, FIG. 5 is a view similar to FIG. 3, showing step engagement that damps rebound of the vehicle from impact with the barrier wall.

PREFERRED EMBODIMENT

Referring now to the drawings, the barrier is a modular unit of elongated uniform cross section comprised of a planar footing 10 with a barrier wall 11 projecting upright along its outside margin. A feature is the substantially extensive footing 10 and its upper surfaces which comprise a shoulder characterized by offset inclined surfaces 12 and 13, joined by an outwardly faced step face 14 that functions to damp rebound of the vehicle after impact with said barrier wall. The lower portion of the barrier wall 11 is a concaved continuation of the outer inclined surface 13, the upper portion of said barrier wall being a convex continuation of the lower portion.

The footing 10 is a horizontally disposed slab of poured concrete having a flat bottom 15, an inner face 16 and an outer face 17. The inner face 16 is angularly disposed so as to toe under the edge of the roadway pavement at 18 (see FIG. 3) and of a height equal to and/or greater in thickness than said pavement. The outer face 17 is vertically disposed or inwardly slanted, or both as shown, and of a height coincident with the top of the barrier wall 11. For example, the lower vertical portion a of face 17 is below grade, while the upper slanted portion b is above grade and establishes the back of the barrier wall.

The barrier wall 11 is a vertically disposed continuation of and integral with the footing 10, and it is comprised of the aforementioned lower portion or concaved face 20 and upper portion or convex face 21 terminating at a top face 22. The height of this barrier wall 11 is related to the wheel or tire sizes of the vehicles, passenger cars and the like, whereby the top face 22 is substantially coincidental with the axle heights of said vehicles, when said wheel or tire thereof is engaged with the outer shoulder surface 13, as shown in FIG. 3. Accordingly, the standard sizes of vehicle wheels and tires are to be taken into consideration; wheel diameters varying for example from twenty inches to twenty-four inches; and tire cross sections varying for example from six inches width to eight inches width. Also, the chassis height and body or bumper height above the pavement is to be considered; and this dimension ranges for example, from twelve to fifteen inches. It is to be understood that these aforementioned dimensions will vary, and that the safety barrier features herein disclosed are proportioned to be operative within selected ranges of those dimensions.

Figure 4:
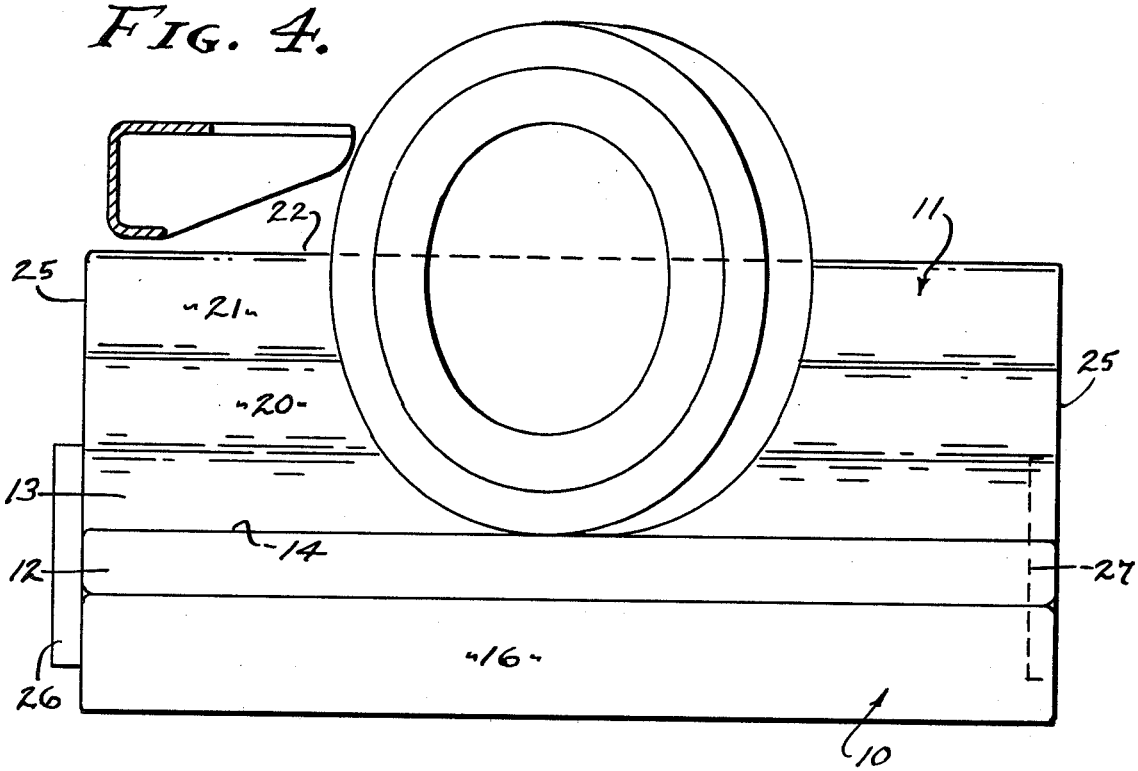
FIG. 4 is an elevational view taken as indicated by line 4—4 on FIG. 2, showing typical wheel diameter and barrier wall proportions and bumper clearance.

The inner inclined shoulder surface 12 rises outwardly from the inner face 16 at approximately 20° of angle (as shown), and of a width approximately and at least equal to the width of a tire tread of six to eight inches and preferably the latter more or less. The ideal angle of rise is 22°–23°. In accordance with this invention, a full sized vehicle wheel with an eight inch track width is fully supported upon the inclined shoulder surface 12 when turned (steered) at 25° of angle thereto, as shown by phantom lines in FIG. 3. It is this incline that has a steering effect which tends to turn the front wheel of a vehicle back toward the roadway. This incline also raises the vehicle for clearance of its front bumper, or other body parts, above the barrier wall 11, as shown in FIG. 4.

The outer inclined shoulder surface 13 is offset below the above described surface 12 and is preferably in a plane recessed from and parallel to the plane of surface 12. The offset is less than half the depth of the tire cross section, or two to three inches as shown. Accordingly, the step face 14 is comparable to said offset dimension and at obtuse angles of joinder with the two inclined surfaces 12 and 13, for example at 45° angle thereto. This incline is engageable with the inside wall of a tire to retard it and to straighten its direction and steering, so as to induce straight forward motion while reducing rebound of the vehicle toward the roadway. Accordingly, the barrier wall 11 presents an inwardly faced abuttment disposed toward the roadway, whereas the step face 14 presents an outwardly faced abuttment disposed away from the roadway. The barrier wall top 22 is of a height substantially equal to the axle height of the vehicle wheel, and is thereby made substantially impassible. However, the step wall 14 is of a height that is passible and adapted to be negotiated and driven over by the vehicle, but with restriction that either retards rebound of the vehicle or that must be deliberately overcome by the driver.

A feature of this invention is that the wheel and tire tread of the vehicle is accommodated up to a tolerable angle of approach of approximately 25°, without being jammed or pinched between the barrier wall 11 and step face 14. In practice therefore, the outer inclined surface 13 is substantially twice the width of the tire tread to be encountered thereby, and substantially greater than half the diameter of the said tire. This proportioning is shown in the drawings and is to be distinguished from a surface width and/or groove that little more than can receive and accommodate the width of a tire. As a result, the vehicle wheel can remain free to be steered for control of the vehicle and its ultimate return to the roadway.

Figure 1:
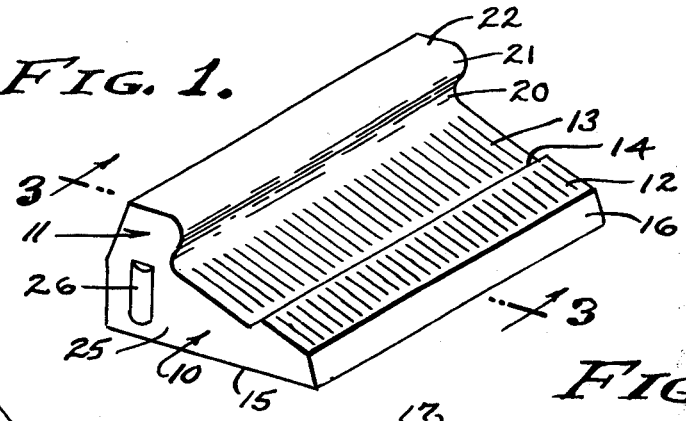
FIG. 1 is a perspective view of a modular unit of the safety barrier of the present invention.
Figure 2:
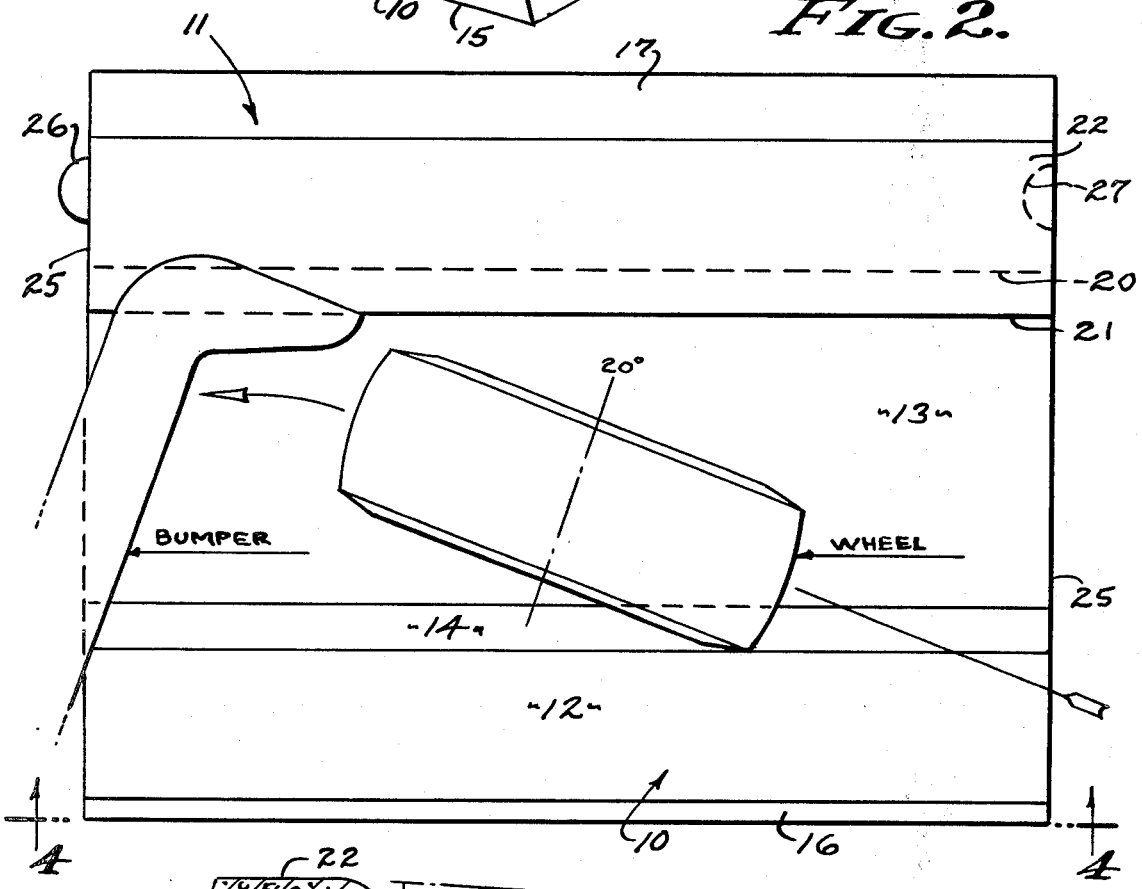
FIG. 2 is a plan view of the safety barrier, showing engagement therewith by a front wheel and bumper of a vehicle approaching at a 20° angle.

From the foregoing it will be seen that this module unit vehicle safety barrier is readily fabricated of poured concrete with normal ends 25 adapted to be placed in opposition and in a continuous series with keys 26 engageable in notches 27 for alignment of the safety barrier configuration. The combined shoulder footing 10 and barrier wall 11 is essentially a low lying obstruction that engages only with the tread and sidewalls of the vehicle wheel, and because of the substantial width of the footing 10 there is little overturning moment or tendancy therefor. As shown best in FIG. 1 of the drawings, the surfaces 12 and 13 are sufficiently corrugated to establish a vibration that will resound in the vehicle encountering the same. The incline of the surfaces 12 and 13 is outward and upward from the pavement of the roadway, and at a substantial degree of angle which does not adversely affect steering of the vehicle but which in fact enhances steering involuntarily or otherwise to straighten the progress of a vehicle encountering the same. That is, the inclined angle of the surfaces 12 or 13 tends to steer the wheel toward the roadway. Firstly, the wheel is free to react to the inclined surface 12, and if reaction is insufficient the wheel will roll over or onto the inclined surface 13 of wider configuration. The accommodation within the confines of the barrier wall 11 and step face 14 affords a margin of safety for regaining control, the face 14 preventing or retarding rebound while the driver can regain control for deliberate return of the vehicle to the roadway.

Having described only a typical preferred form and application of our invention, we do not wish to be limited or restricted to the specific details herein set forth, but wish to reserve to ourselves any modifications or variations that may appear to those skilled in the art as set forth within the limits of the following claims.

We claim:

1. A vehicle safety barrier for the encounter of a vehicle wheel to control steering and rebound of said vehicle and including;

an elongated horizontally disposed footing comprised of a shoulder having inner and outer surfaces inclined upwardly and outwardly from an inner face fixedly joined to the pavement surface of the roadway, the outer inclined surface being offset below the inner inclined surface with an outwardly disposed step face joining the two, and an elongated vertically disposed barrier wall comprised of an inwardly disposed concaved lower face portion continuation of the outer surface of the footing shoulder and an inwardly disposed convex upper face portion continuation of said lower face portion, the barrier wall having a top face substantially coincidental with the axle height of the vehicle, the step face of the footing shoulder and the upper face portion of the barrier wall being in spaced opposition a distance substantially greater than the width of a tire tread of the vehicle wheel, whereby a vehicle wheel is steered toward the roadway by the inclined shoulder surfaces, is caused to rebound in the event of impact with the barrier wall, and return from the outer shoulder surface restricted by the step face, for regained control of the vehicle by a driver thereof.

2. The vehicle safety barrier as set forth in claim 1, wherein the inner inclined shoulder surface is at least equal in width to the tire tread width of the vehicle.

3. The vehicle safety barrier as set forth in claim 1, wherein the outer inclined shoulder surface is of a width defined by the barrier wall and step face spaced to clear a vehicle wheel turned to a 25° angle of approach to the safety barrier.

4. The vehicle safety barrier as set forth in claim 1, wherein the outer inclined shoulder surface is substantially twice the width of the vehicle tire tread.

5. The vehicle safety barrier as set forth in claim 1, wherein the outer inclined shoulder surface is substantially greater than half the diameter of the vehicle tire.

6. The vehicle safety barrier as set forth in claim 1, wherein the inner inclined shoulder surface is at least equal in width to the tire tread width of the vehicle, and wherein the outer inclined shoulder surface is of a width defined by the barrier wall and step face spaced to clear a vehicle wheel turned to a 25° angle of approach to the safety barrier.

7. The vehicle safety barrier as set forth in any one of claims 1, 2 or 3, wherein the incline of the shoulder surfaces is substantially 20°.

8. The vehicle safety barrier as set forth in any one of claims 1, 2 or 3, wherein the incline of the shoulder surfaces is in the range of 22° to 23°.

9. The vehicle safety barrier as set forth in any one of claims 1, 2 or 3, wherein the inner and outer inclined shoulder surfaces are offset less than half the depth of the vehicle tire cross section.

10. The vehicle safety barrier as set forth in any one of claims 1, 2 or 3, wherein the inner and outer inclined shoulder surfaces are offset in the range of two to three inches.

11. The vehicle safety barrier as set forth in any one of claims 1, 2 or 3, wherein the step face joining the inner and outer inclined shoulder surfaces is disposed at substantially 45° thereto.

12. The vehicle safety barrier as set forth in any one of claims 1, 2 or 3, wherein the step face joining the inner and outer inclined shoulder surfaces is disposed at substantially 45° thereto, and said inner and outer inclined shoulder surfaces are offset less than half the depth of the vehicle tire cross section.

13. The vehicle safety barrier as set forth in any one of claims 1, 2 or 3, wherein the footing and barrier wall are integrally poured of concrete and the like.

14. The vehicle safety barrier as set forth in any one of claims 1, 2 or 3, wherein the footing and barrier wall are integrally poured elongated module units of concrete and the like.

15. The vehicle safety barrier as set forth in any one of claims 1, 2 or 3, wherein the footing and barrier are of modular unit configuration with opposite end male and female key forms for aligned engagement of adjacent modular units in continuous barrier formation.

* * * * *